US009046096B2

(12) United States Patent
Diekmeyer et al.

(10) Patent No.: US 9,046,096 B2
(45) Date of Patent: Jun. 2, 2015

(54) PISTON AIR COMPRESSOR

(75) Inventors: Heinrich Diekmeyer, Barsinghausen (DE); Heinrich Schlossarczyk, Wennigsen (DE)

(73) Assignee: WABCO GmbH, Hannover (DE)

( * ) Notice: Subject to any disclaimer, the term of this patent is extended or adjusted under 35 U.S.C. 154(b) by 754 days.

(21) Appl. No.: 12/733,248

(22) PCT Filed: Jul. 1, 2008

(86) PCT No.: PCT/EP2008/005372
§ 371 (c)(1),
(2), (4) Date: Jul. 27, 2011

(87) PCT Pub. No.: WO2009/024210
PCT Pub. Date: Feb. 26, 2009

(65) Prior Publication Data

US 2011/0277625 A1 Nov. 17, 2011

(30) Foreign Application Priority Data

Aug. 21, 2007 (DE) ..... 10 2007 039 476

(51) Int. Cl.

| | |
|---|---|
| ***F04B 49/035*** | (2006.01) |
| ***F04B 49/16*** | (2006.01) |
| ***F04B 53/10*** | (2006.01) |
| ***F04B 39/00*** | (2006.01) |
| ***F04B 39/08*** | (2006.01) |

(52) U.S. Cl.
CPC ..... *F04B 49/16* (2013.01); *F04B 53/10* (2013.01); *F04B 49/035* (2013.01); *F04B 39/0055* (2013.01); *F04B 39/08* (2013.01)

(58) Field of Classification Search
CPC ..... F04B 53/10; F04B 49/035
USPC ..... 417/559, 440.307, 440, 415, 380, 384
See application file for complete search history.

(56) References Cited

U.S. PATENT DOCUMENTS

| | | | | |
|---|---|---|---|---|
| 1,248,119 | A | | 11/1917 | Holdsworth |
| 1,334,281 | A | | 3/1920 | Constantinesco |
| 1,653,110 | A | * | 12/1927 | Le Valley ..... 137/599.16 |
| 2,594,815 | A | | 4/1952 | Smith |
| 2,913,985 | A | | 11/1959 | Harrison |
| 3,291,054 | A | | 12/1966 | McKenzie |
| 3,415,441 | A | | 12/1968 | Kehler |

(Continued)

FOREIGN PATENT DOCUMENTS

| | | |
|---|---|---|
| AT | 265 498 | 10/1968 |
| AT | 277436 | 12/1969 |

(Continued)

OTHER PUBLICATIONS

R.J. Dale et al., Advances in Commercial Vehicle Air Compressor Technology, 6th Int'l Pacific Conference on Autommotive Engineering, Society of Automotive Engineers of Korea.

(Continued)

*Primary Examiner* — Charles Freay
*Assistant Examiner* — Christopher Bobish
(74) *Attorney, Agent, or Firm* — Kramer Levin Naftalis & Frankel LLP

(57) ABSTRACT

A piston air compressor having a suction chamber and a connection chamber separated from the suction chamber. An air channel is provided from the connection chamber to the suction chamber.

19 Claims, 9 Drawing Sheets

(56) References Cited

U.S. PATENT DOCUMENTS

| | | | | | |
|---|---|---|---|---|---|
| 3,934,990 | A | | 1/1976 | Ide, III | |
| 4,407,640 | A | | 10/1983 | Namekata | |
| 4,472,112 | A | | 9/1984 | Unger | |
| 4,498,848 | A | | 2/1985 | Petrovsky et al. | |
| 4,519,750 | A | | 5/1985 | Kurahashi et al. | |
| 4,522,568 | A | | 6/1985 | Gelse et al. | |
| 4,534,710 | A | | 8/1985 | Higuchi et al. | |
| 4,594,059 | A | | 6/1986 | Becker | |
| 4,612,962 | A | | 9/1986 | Purvis | |
| 4,817,660 | A | | 4/1989 | Deike et al. | |
| 4,932,631 | A | | 6/1990 | Heger et al. | |
| 5,030,067 | A | | 7/1991 | Ushiota et al. | |
| 5,101,857 | A | | 4/1992 | Heger et al. | |
| 5,106,270 | A | | 4/1992 | Goettel et al. | |
| 5,385,449 | A | | 1/1995 | Wenzel | |
| 5,438,829 | A | | 8/1995 | Kubota et al. | |
| 5,503,537 | A | * | 4/1996 | Schlossarczyk et al. | 417/296 |
| 5,647,731 | A | * | 7/1997 | Onozawa | 417/295 |
| 5,820,105 | A | * | 10/1998 | Yamaji et al. | 251/368 |
| 5,951,260 | A | * | 9/1999 | Cramer et al. | 417/282 |
| 6,257,838 | B1 | | 7/2001 | Schlossarczyk et al. | |
| 6,898,934 | B1 | * | 5/2005 | Bayer et al. | 60/605.1 |
| 2004/0040601 | A1 | * | 3/2004 | Koelzer | 137/522 |
| 2004/0213679 | A1 | * | 10/2004 | Cornwell | 417/307 |
| 2008/0307812 | A1 | * | 12/2008 | Hirota | 62/228.3 |

FOREIGN PATENT DOCUMENTS

| | | | |
|---|---|---|---|
| DE | 520 554 | | 2/1931 |
| DE | 695726 | | 8/1940 |
| DE | 1 076 152 | | 2/1960 |
| DE | 1 157 343 | | 11/1963 |
| DE | 1 628 163 | | 8/1971 |
| DE | 26 33 654 | | 2/1977 |
| DE | 32 14713 | A1 | 10/1983 |
| DE | 32 11 598 | A1 | 11/1983 |
| DE | 33 29 790 | C2 | 2/1985 |
| DE | 36 42 852 | A1 | 6/1988 |
| DE | 39 09 531 | A1 | 6/1990 |
| DE | 39 04 169 | A1 | 8/1990 |
| DE | 39 04 172 | A1 | 8/1990 |
| DE | 43 21 013 | A1 | 1/1995 |
| DE | 198 50 269 | | 5/2000 |
| EP | 0 335 716 | A1 | 10/1989 |
| GB | 829060 | | 2/1960 |
| GB | 1 334 394 | | 10/1973 |
| GB | 2 070 698 | A | 9/1981 |
| GB | 2 192 945 | A | 1/1988 |
| GB | 2 217 792 | A | 11/1989 |

OTHER PUBLICATIONS

Bendix 1A190R Air Compressor 2-Page Publication Dated Apr. 1991.

* cited by examiner

PISTON AIR COMPRESSOR

FIELD OF THE INVENTION

The present invention generally relates to a piston air compressor that includes a suction chamber and a connection chamber separated from the suction chamber.

BACKGROUND OF THE INVENTION

Piston air compressors are used in the form of, for example, single-cylinder piston compressors in pneumatic systems of heavy motor trucks. A piston air compressor of the general type under consideration has a piston that runs in a cylinder. During its travel from a bottom dead point to a top dead point, the piston compresses air, which then emerges from the piston air compressor as compressed air through a diaphragm valve functioning as a check valve. The compressed air is passed via a pressure line into an air-conditioning system, which dries the compressed air and passes it further via a control valve to consuming loads, such as a compressed-air tank.

If the compressed-air tank is completely filled, the piston air compressor is switched to idling. In this way the pressure line remains under pressure. At the same time, a connection chamber in the single-cylinder piston air compressor is connected. During its travel from the bottom dead point to the top dead point, the piston compresses the air in the connection chamber, and the compressed air forces the piston to travel back from the top dead point to the bottom dead point so that no energy other than flow losses has to be expended during idling. The maximum peak pressure that can be developed is inversely proportional to the volume of the connection chamber. As an example, if the connection chamber is precisely as large as the displacement volume, the peak pressure when the piston is at the top dead point corresponds to twice the minimum pressure when the piston is at the bottom dead point.

In two-piston or multi-piston compressors, individual cylinders are in communication with one another via a connection chamber during idling such that substantially no energy is needed. A disadvantage of such piston air compressors is that the diaphragm valve used as a check valve has a certain leakage flow, which is expressed in liters per minute and is also known as "looseness." Because of the looseness, compressed air from the pressure line can flow into the cylinders of the piston air compressor. Thus, high pressures are reached during compression. Because of these high pressures, compressed air flows along between the cylinder and piston and thus arrives in the compressor housing, in which oil lubrication of the piston compressor also takes place. For environmental reasons, with heavy motor trucks, this air must be passed through the internal combustion engine in order to avoid polluting the environment with air containing lubricating oil. If the internal combustion engine of the heavy motor truck is equipped with a turbocharger, however, the air containing lubricating oil may lead to accelerated aging of the turbocharger.

SUMMARY OF THE INVENTION

Generally speaking, it is an object of the present invention to provide a piston air compressor that avoids the disadvantages associated with conventional piston air compressors.

In accordance with embodiments of the present invention, a piston air compressor is provided with an air duct from a connection chamber to a suction chamber. Advantageously, part of the compressed air flowing from a pressure chamber of the piston air compressor during compression by the piston can escape into the suction chamber so that excessive pressure cannot be built up in either the pressure chamber or the connection chamber. As a result, any air flow between the cylinder and piston is significantly reduced or suppressed. As an example, air forced into the suction chamber from the connection chamber can be discharged into an intake region of the internal combustion engine of a heavy motor truck. The air discharged in this way is substantially free of lubricating oil and is not harmful to a turbocharger, if such is present.

Another advantage of the piston air compressor according to embodiments of the present invention is that it can be implemented easily. Thus, the air duct can be implemented easily, for example, by a bore of appropriate size in a dividing wall between the suction chamber and the connection chamber. As a result, it is also advantageously possible to retrofit already existing piston air compressors.

An air duct will be understood to include any structure within the piston air compressor that permits air to travel from the suction chamber into the connection chamber. Examples are recesses, bores, ducts or lines, all of which may comprise or house valves, flaps, diaphragms or similar components.

The connection chamber will be understood to be a space that does not belong to the suction chamber or to the pressure chamber. The suction chamber will be understood to be a chamber through which the air is sucked during an intake operation of the piston air compressor. The pressure chamber will be understood to be a chamber through which the compressed air exits the piston air compressor. In a piston air compressor having two or more pistons, the connection chamber is, for example, that chamber through which the air flows from one piston to the next piston during idling operation.

In a preferred embodiment, one or both of the suction chamber and the connection chamber can be formed in a cylinder head of the piston compressor. In this way, there is achieved a piston air compressor that is particularly easy to manufacture.

Preferably, the connection chamber is separated by a partition from the suction chamber, and the air duct is formed in the partition. In this way, the air duct can be implemented in particularly simple manner. Preferably, the air duct is a recess, especially a bore in the partition.

In addition, a valve or a throttle can be installed in the air duct, especially a valve in which the cross section or passing pressure can be adjusted.

For a given piston air compressor having a check valve between the cylinder and outgoing pressure line, wherein the check valve has a given looseness, the air duct is preferably chosen such that, during idling operation of the piston air compressor, the pressure in the connection chamber does not rise over a prolonged period. A cross-sectional area of smaller than about 15 $mm^2$ can be sufficient to meet this requirement. Also, the air duct should preferably have a cross-sectional area larger than about 0.5 $mm^2$. It is particularly favorable when the cross-sectional area is individually adapted for the respective piston air compressor or can be adjusted manually and/or automatically, for example, by means of an adjusting screw and/or a pressure-limiting valve.

In accordance with exemplary embodiments of the present invention, piston air compressors are preferably single-cylinder piston air compressors. Alternatively, the piston air compressor is a two-cylinder piston air compressor or a multi-cylinder piston air compressor.

To prevent backflow of air from the suction chamber into the connection chamber, the air duct is preferably equipped with a check valve, especially a ball valve. This check valve shuts off any air flow from the suction chamber into the connection chamber.

Alternatively or additionally, the check valve can comprise a diaphragm, especially a sheet-metal diaphragm, at least portions of which have a membrane contour corresponding to an internal contour of the suction chamber. In such case, the diaphragm of the check valve functions as a closing member. In the case of an overpressure in the suction chamber, the diaphragm of the check valve bears against the internal contour of the suction chamber and thus prevents air from flowing out of the suction chamber.

Still other objects and advantages of the present invention will in part be obvious and will in part be apparent from the specification.

The present invention accordingly comprises the features of construction, combination of elements, and arrangement of parts that will be exemplified in the constructions herein set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
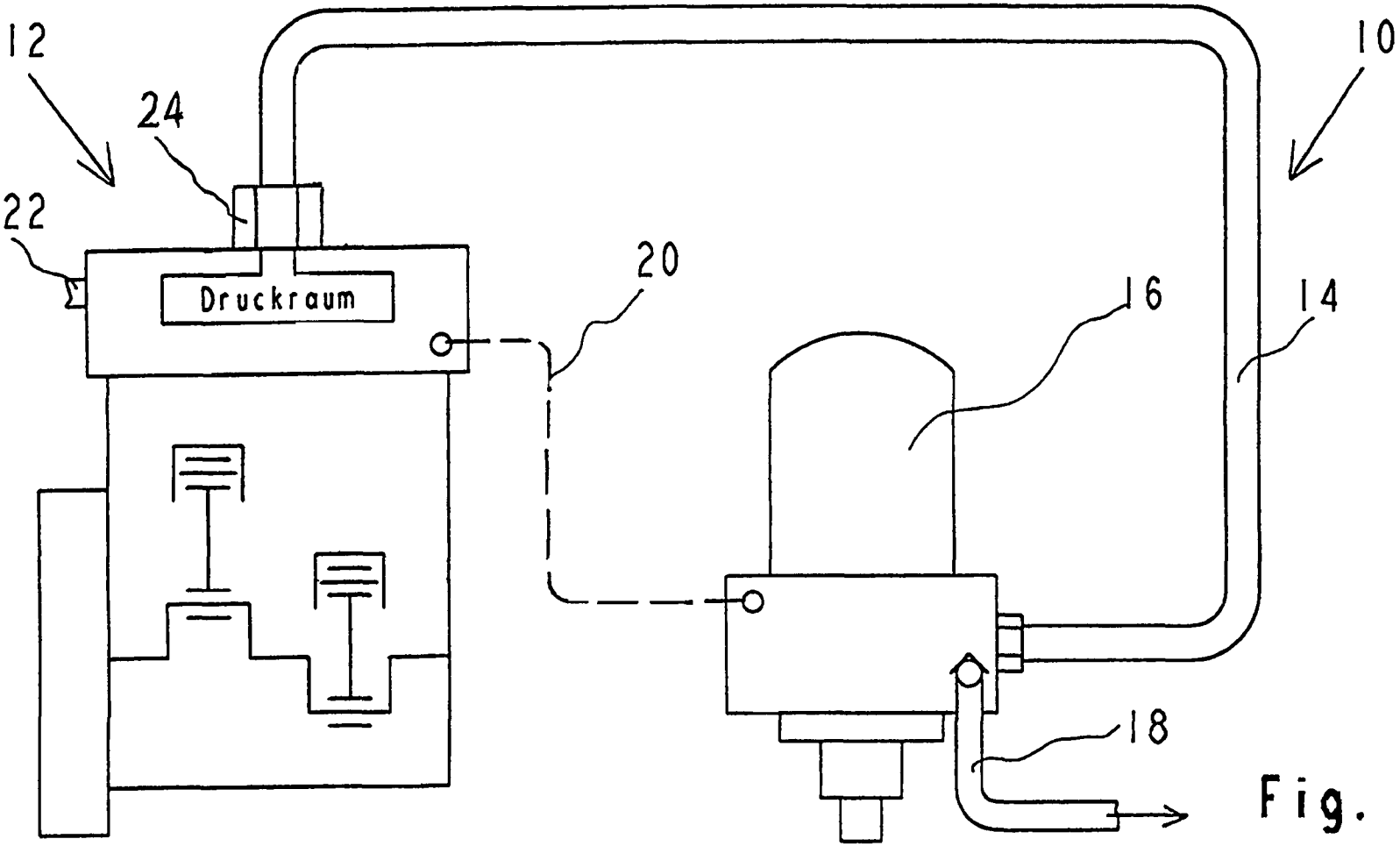
FIG. 1 shows an embodiment of an inventive pneumatic system.

Referring now to the drawing figures, FIG. 1 schematically shows a pneumatic system 10 for a heavy motor truck, not illustrated, having a piston air compressor 12, a pressure line 14, an air-conditioning unit 16, a supply line 18 and an electrical control line 20.

During load operation, piston air compressor 12 sucks in ambient air through an intake aperture 22, compresses it and discharges it into pressure line 14. When a given pressure $p_{max}$ is present in supply line 18, air-conditioning unit 16 transmits a signal to piston compressor 12 via electrical control line 20, whereupon the compressor is automatically switched to idling. In this case, further air is no longer sucked in, and a check valve 24 prevents compressed air from pressure line 14 from entering piston compressor 12.

Figure 2:
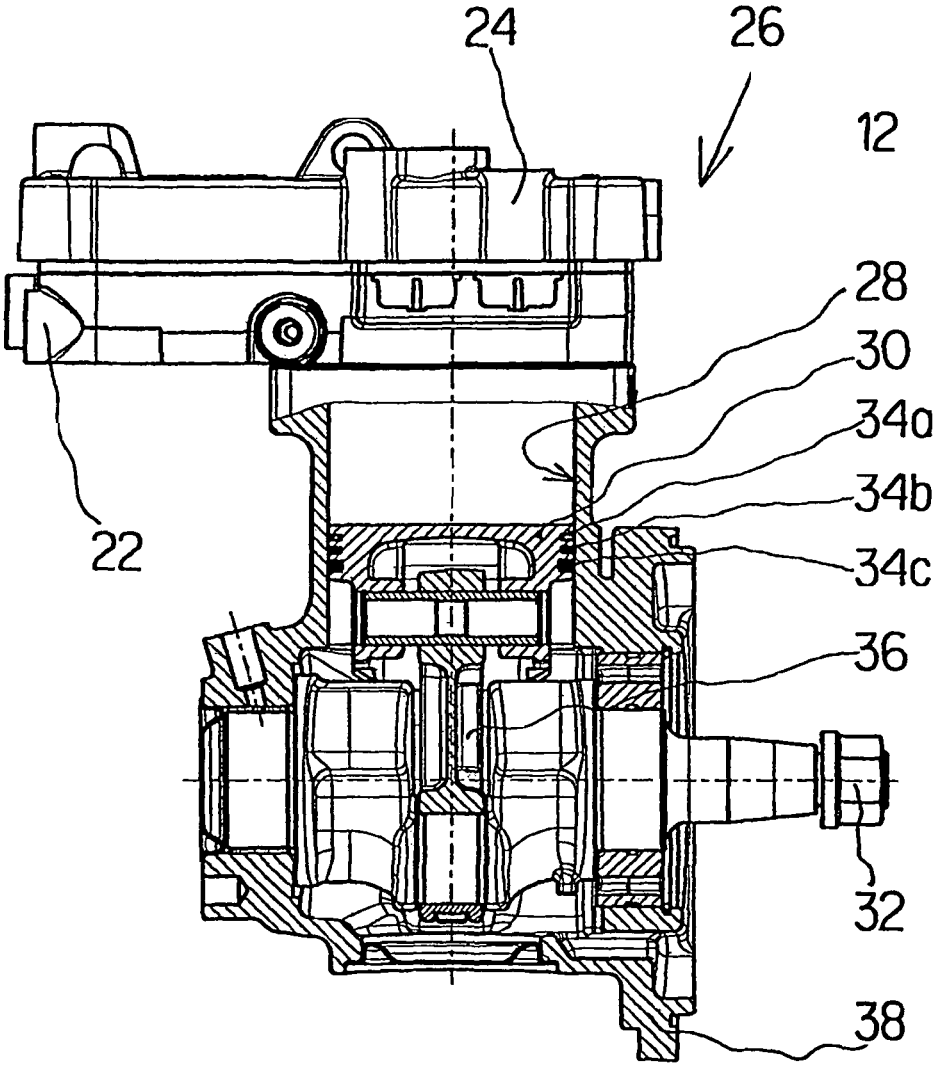
FIG. 2 shows an inventive single-cylinder piston air compressor embodiment in cross-sectional view.

FIG. 2 shows an exemplary embodiment of piston air compressor 12, which is provided with a cylinder head 26, a cylinder 28, a piston 30 running in cylinder 28 and a crank mechanism 32. Piston 30 has piston rings 34*a*, 34*b* and 34*c* and is driven forward and back by a connecting rod 36. Inside a housing 38, there is disposed an oil-lubricating system (not illustrated) that lubricates piston 30. Housing 38 is in communication via a vent line (not illustrated) with an intake region of an internal combustion engine of the heavy motor truck.

Figure 3:
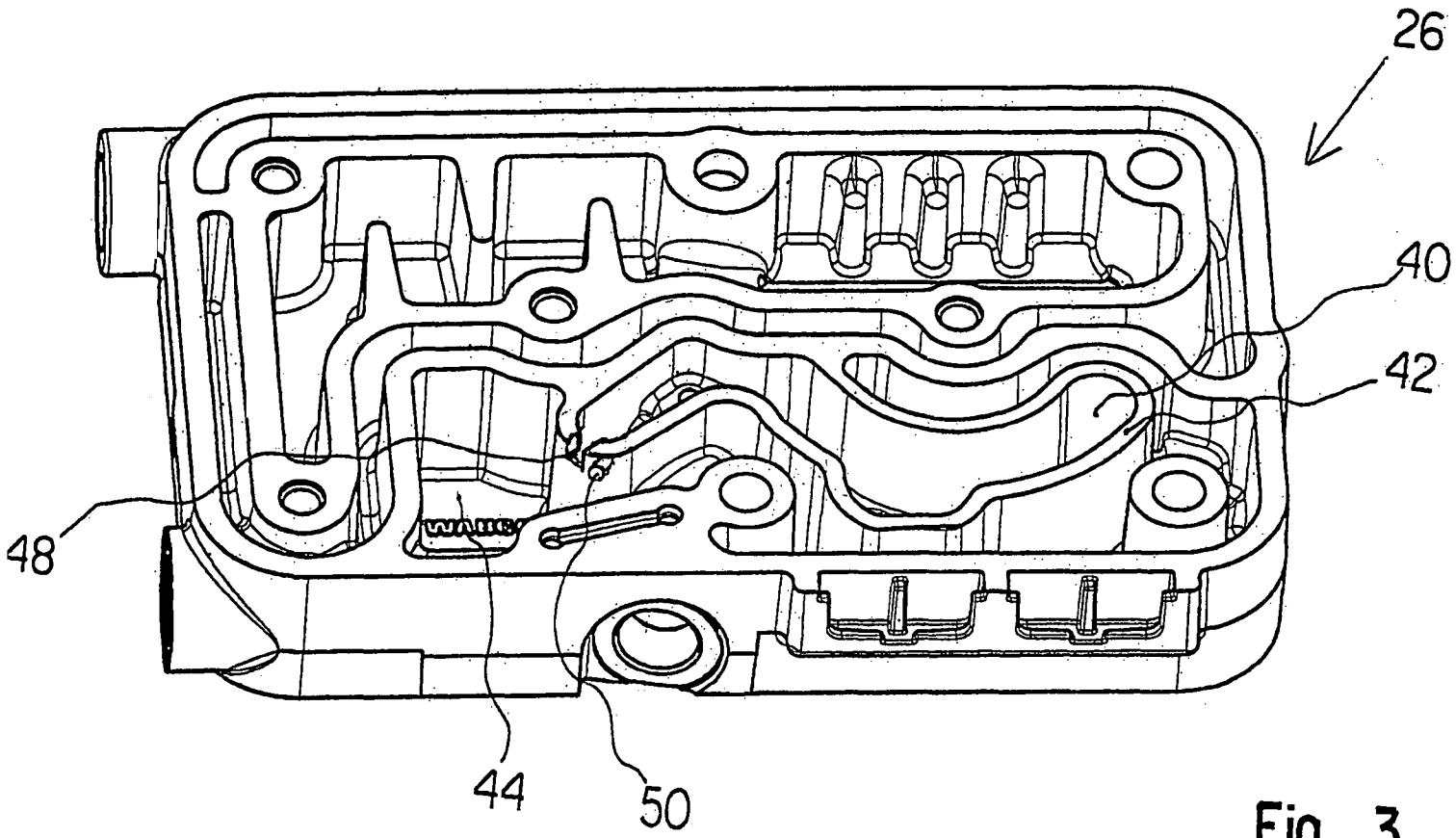
FIG. 3 shows a cylinder head of the single-cylinder piston air compressor according to FIG. 2 in perspective view.

FIG. 3 shows cylinder head 26 in perspective view in accordance with an exemplary embodiment of the present invention. The piston runs on the side of the cylinder head remote from the observer. In cylinder head 26, there is formed a suction chamber 40, which is separated by a partition 42 from a connection chamber 44. During operation of the piston air compressor, air flows through entry aperture 22 (see FIG. 2) into suction chamber 40, then from suction chamber 40 into cylinder 28, where it is compressed by cylinder 30 as it moves toward a top dead point. A suction-chamber diaphragm seal, which is not visible in FIG. 3, prevents the compressed air from flowing back into the suction chamber. During load operation, the compressed air is forced into a pressure chamber 46, from which it passes into pressure line 14 (see FIG. 1).

During idling, the air sucked into connection chamber 44 (FIG. 3) is compressed, and it flows from there back into the cylinder, while the piston is moving from the top dead point to a bottom dead point. A governor circuit then exists.

In partition 42 separating suction chamber 40 from connection chamber 44, there is provided an air duct in the form of a recess 48. Alternatively or additionally, an air duct in the form of a bore 50 is provided in partition 42.

If check valve 24 (FIG. 1) is leaky, compressed air flows out of pressure line 14 into pressure chamber 46 (FIG. 3), where it enters cylinder 28 (FIG. 2), from which it enters connection space 44. Part of this excess air is passed through recess 48 or bore 50 into suction chamber 40, and it exits the piston air compressor through entry aperture 22 (FIG. 1).

Figure 4A:
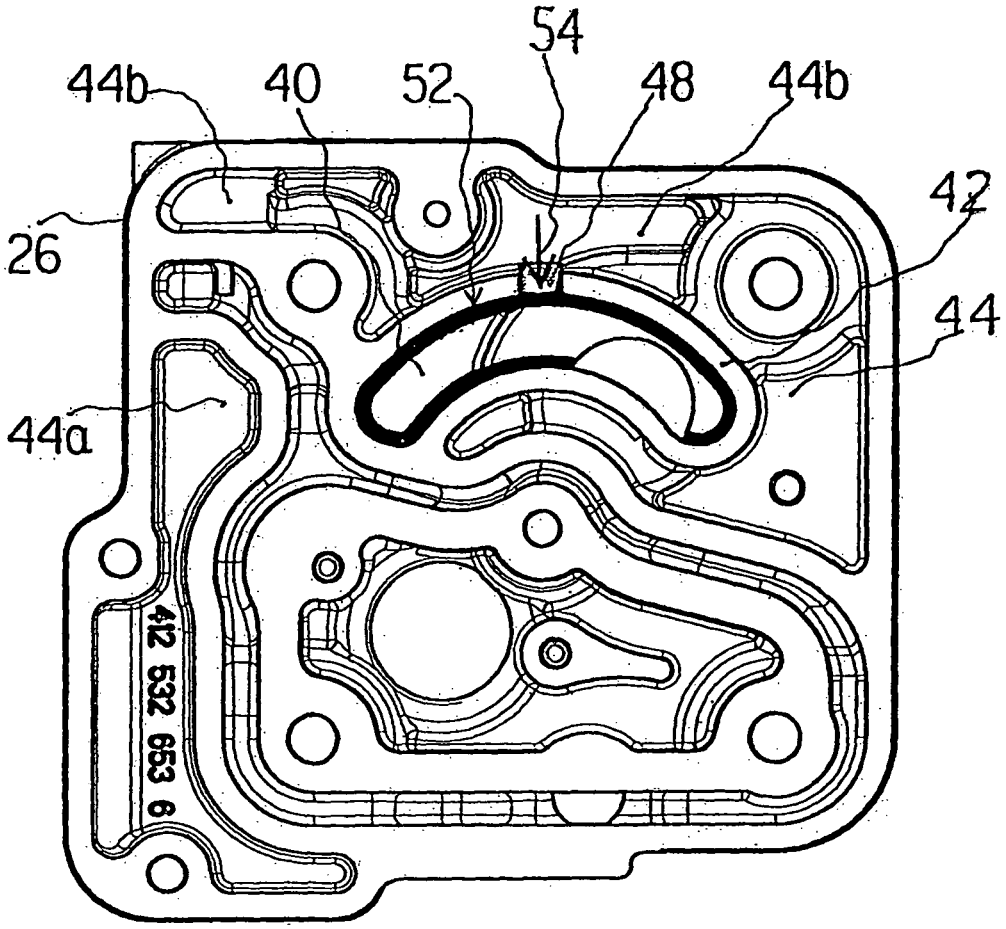
FIG. 4*a* shows an alternative embodiment of a cylinder head of an inventive piston air compressor.

FIG. 4*a* shows an alternative exemplary embodiment in which cylinder head 26 has a two-compartment connection chamber 44*a*, 44*b* and a suction chamber 40 in the form of a partial annulus. In partition 42 between suction chamber 40 and connection chamber 44*b*, there is disposed an air duct in the form of a recess 48, which is bounded on the suction-chamber side by a closing diaphragm 52, which therefore represents a closing member. Closing diaphragm 52 is made of spring-grade sheet steel and has a diaphragm contour corresponding to an internal contour of suction chamber 40. If an air pressure p in connection chamber 44*b* exceeds a given value, this air pressure overcomes the resistance of closing diaphragm 52, allowing compressed air 54 to flow into suction chamber 40.

Figure 4B:
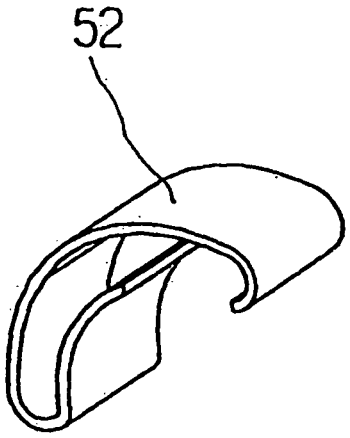
FIG. 4*b* shows a closing member from the cylinder head according to FIG. 4*a*.

FIG. 4*b* shows closing diaphragm 52 in perspective view designed as a curved spring-steel sheet.

Figure 5B:
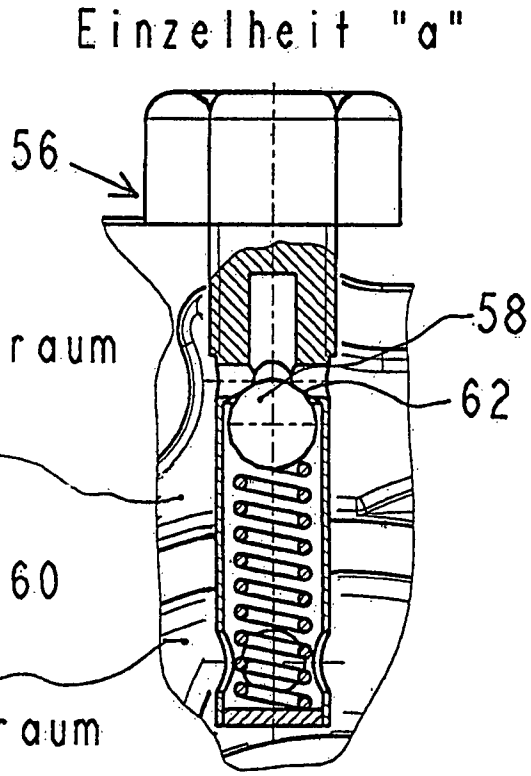
FIG. 5*b* shows a check valve of the cylinder head according to FIG. 5*a*.
Figure 5A:
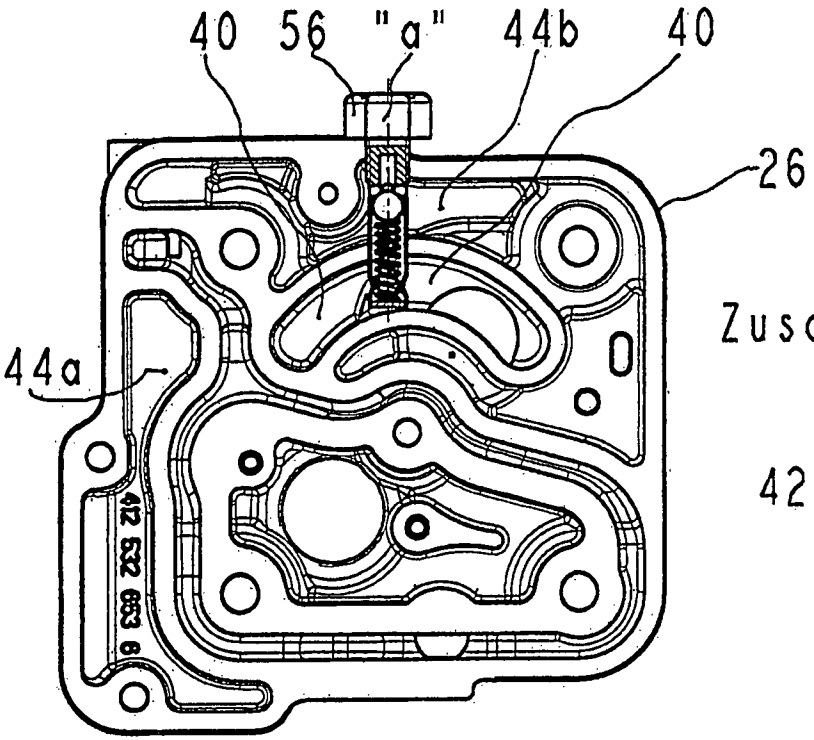
FIG. 5*a* shows a further alternative embodiment of a cylinder head of an inventive piston air compressor.

FIG. 5*a* shows an alternative exemplary embodiment of cylinder head 26 for an inventive single-cylinder piston air compressor embodiment, in which an air duct in the form of a check valve, specifically a ball valve 56, is disposed between connection chamber 44*b* and suction chamber 40.

FIG. 5*b* shows ball valve 56 with a valve ball 58, which is preloaded against a valve seat 62 by means of a spring 60.

Figure 6:
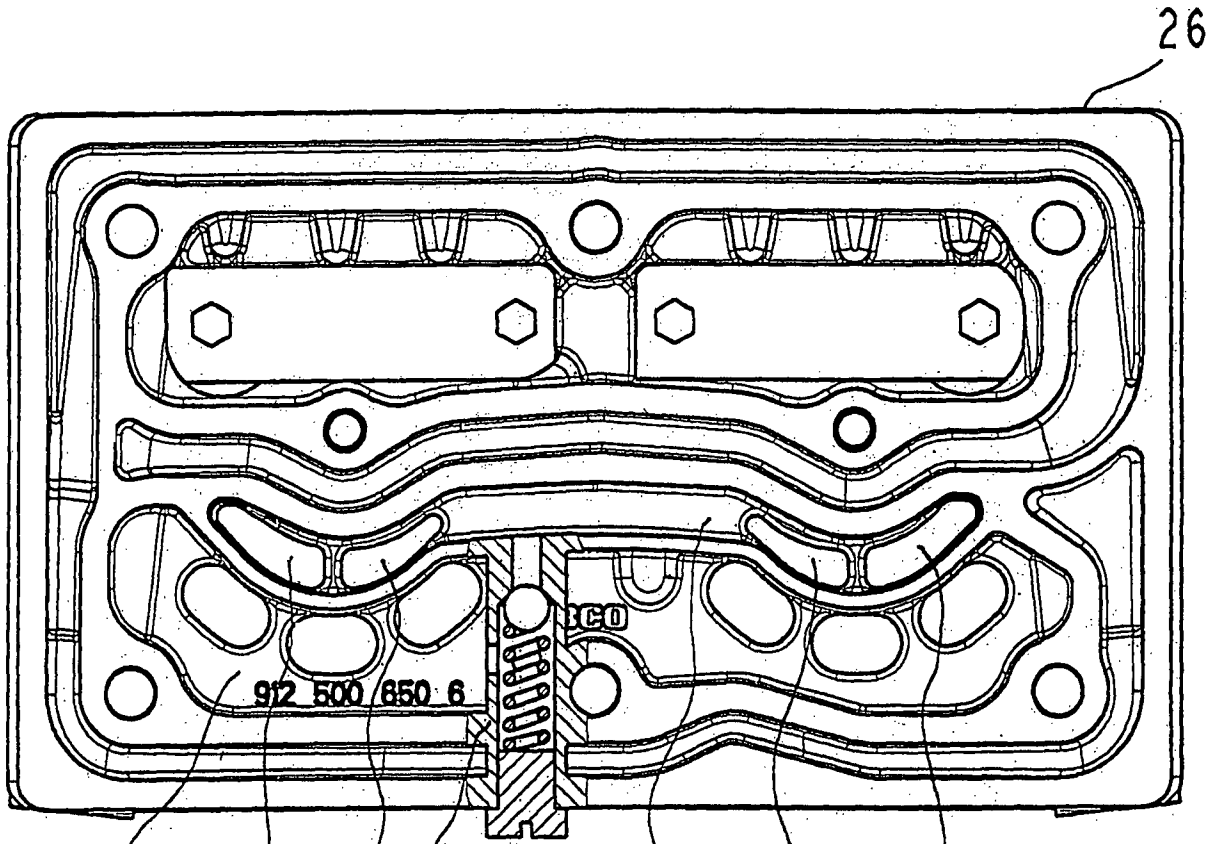
FIG. 6 is an overhead view of a cylinder head of an embodiment of an inventive two-cylinder piston air compressor.

FIG. 6 shows a cylinder head 26 for an inventive two-cylinder piston air compressor embodiment. Between suction chamber 40 and a connection chamber 44, there is again formed an air duct, in which there is disposed a ball valve 56. Via two inflow apertures 64 and 66 respectively, it is possible for air to flow from one of the two cylinders through connection chamber 44 into the respective other cylinder when the piston air compressor is in idling operation so that the connection chamber simultaneously functions as a connecting duct.

Figure 7:
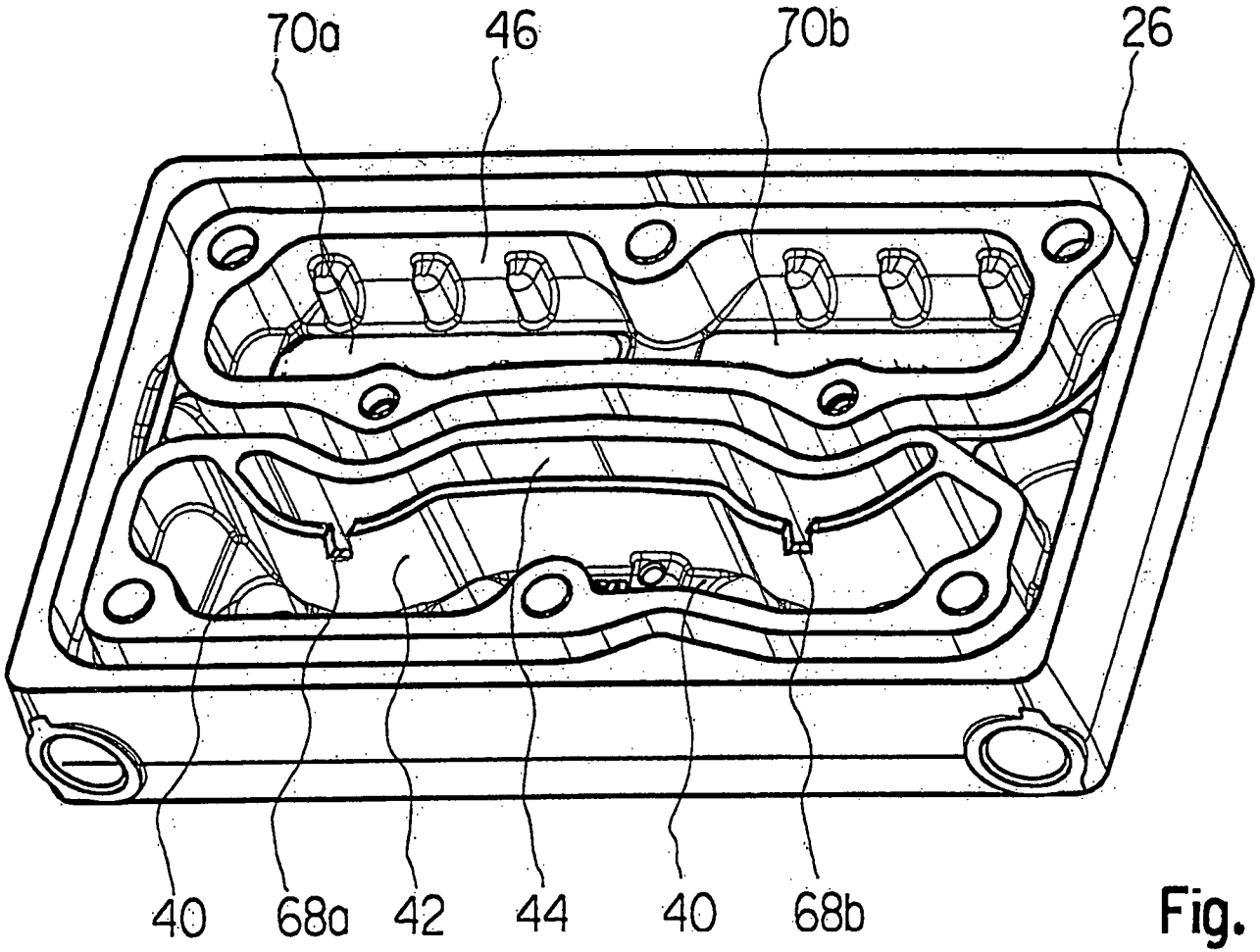
FIG. 7 is a perspective view of a further alternative embodiment of a cylinder head of an inventive two-cylinder piston air compressor.

FIG. 7 shows a further alternative cylinder head 26 for an exemplary embodiment of a piston air compressor, in which two air ducts in the form of recesses 68*a*, 68*b* are provided in partition 42 separating suction chamber 40 from connection chamber 44. Also, in FIG. 7 the pistons of the piston compressor in installation position are located behind cylinder head 26 in viewing direction. What is visible in this view are two pressure-chamber diaphragm valves 70*a*, 70*b* in pressure chamber 46, which permit compressed air to flow from the respective cylinder into pressure chamber 46 and prevent backflow.

Figure 8:
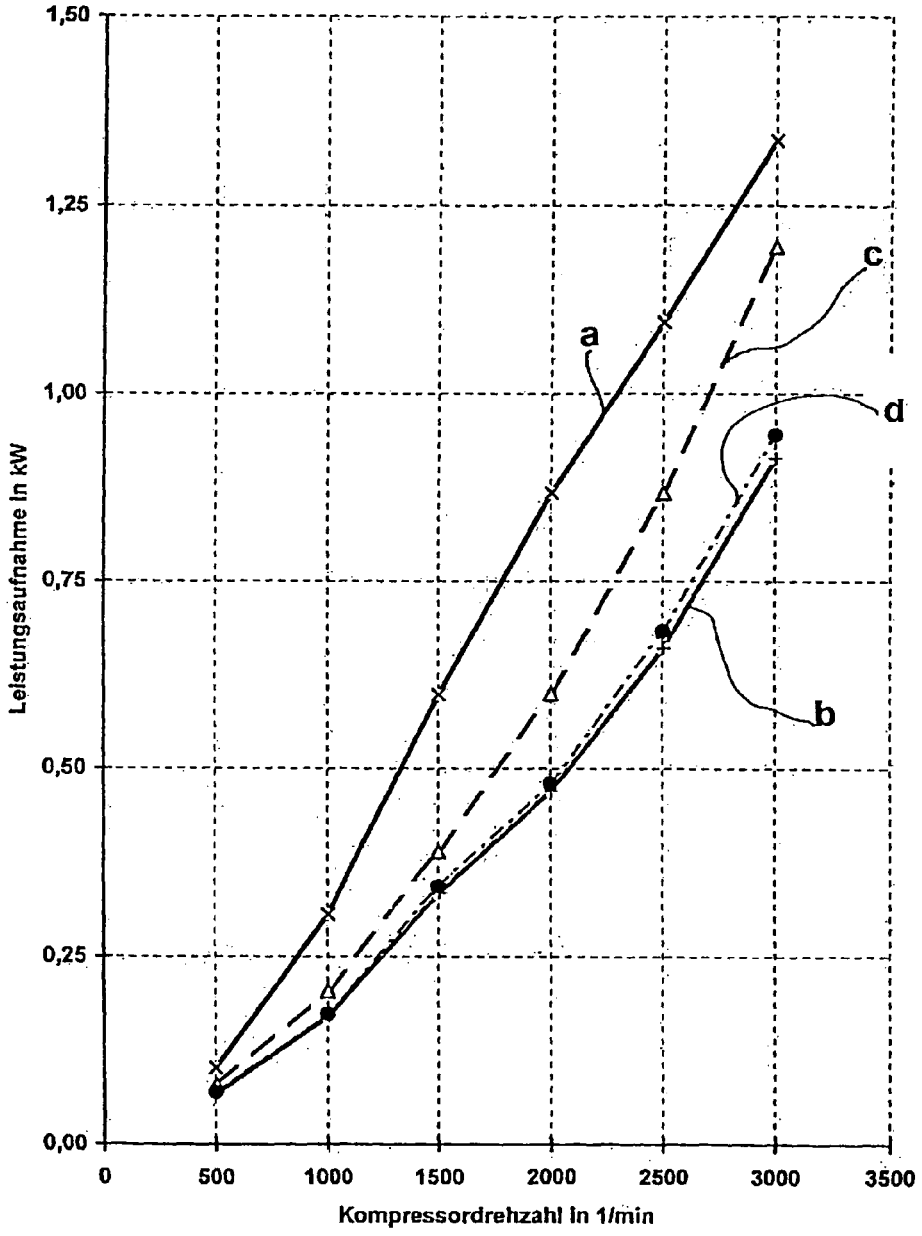
FIG. 8 is an exemplary graphical representation of the power consumption of various piston air compressors plotted against the compressor speed.

FIG. 8 graphically shows the power consumption of various piston air compressors plotted against the speed of the piston air compressor during idling. Each case corresponds to a single-cylinder piston air compressor having a displacement volume of $V_h$=318 $m^3$. Curve a shows the speed-dependent power consumption of a prior-art piston air compressor, in which the compressed air is discharged to the atmosphere during idling. Curve b shows the power consumption for a system according to FIG. 1, in governor mode with a perfectly leak-tight check valve 24 (see FIG. 1). Curve c shows the power consumption of a piston air compressor according to FIG. 1 when check valve 24 has a looseness (leakage flow rate) of 25 L/min, and curve d shows the case according to curve c, except that a bore 50 (see FIG. 3) has been provided in partition 42. The power consumption in this case is considerably smaller than in the bore-free case. Approximately the same power consumption can be achieved by the bore as is possible for a piston air compressor having a perfectly leak-tight check valve 24.

Figure 9:
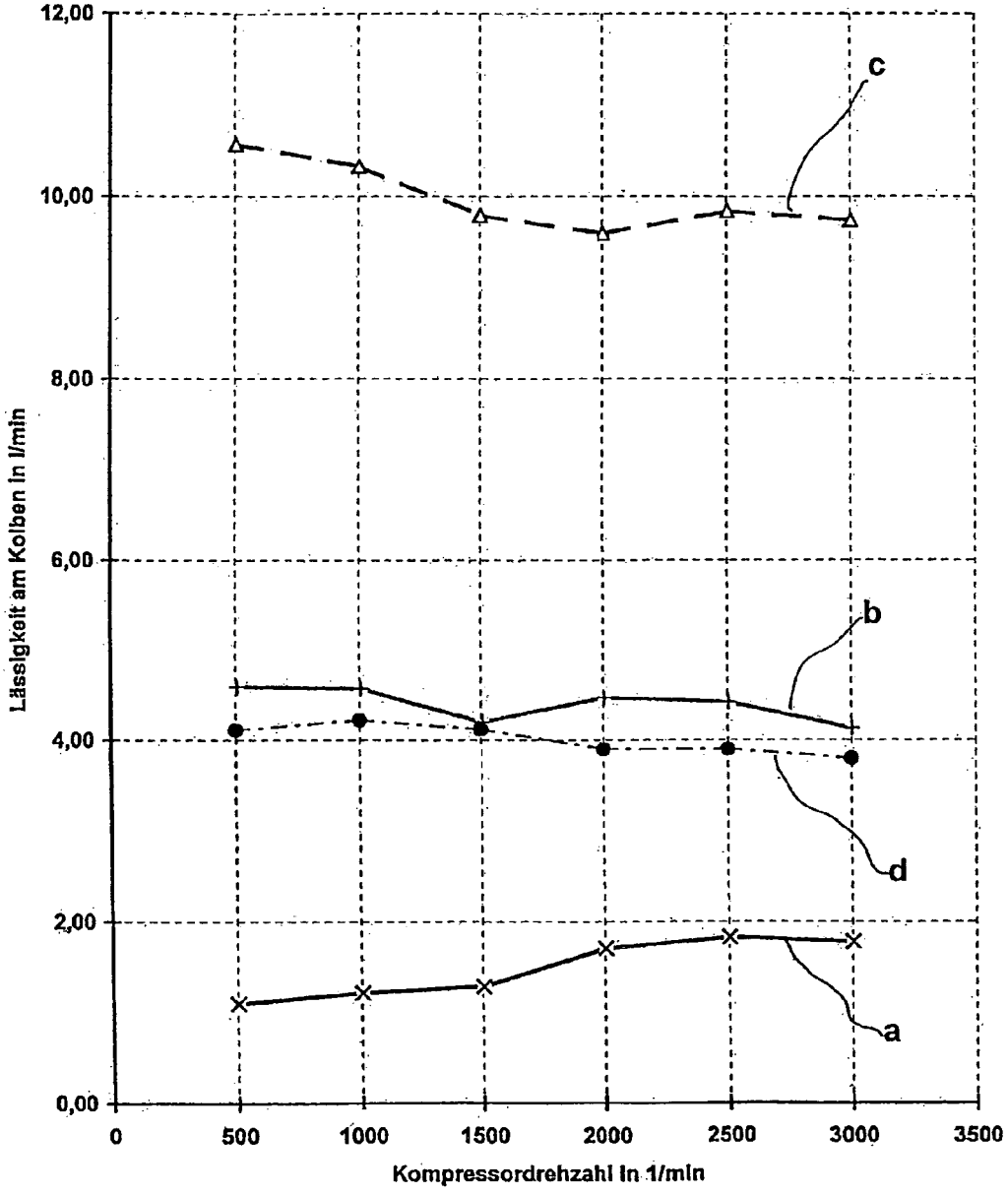
FIG. 9 is an exemplary graphical representation of the looseness during idling operation plotted against the compressor speed for various piston air compressors.

FIG. 9 shows the looseness in idling operation as a function of compressor speed for the cases indicated in FIG. 8. The difference between curves c and b shows the positive influence of the air duct in the form of bore 50 in partition 42 (see FIG. 3).

It will thus be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A piston air compressor, comprising:

a suction chamber configured to pass ambient air received by said piston air compressor to a cylinder for compression;

a pressure chamber coupled to said cylinder;

a connection chamber coupled to said cylinder and separated from said suction chamber by a partition, said connection chamber and said pressure chamber being configured to separately receive compressed air from said cylinder; and an air duct extending from said connection chamber to said suction chamber, said air duct being formed as a recess in an upper surface of said partition and configured to pass said compressed air received by said connection chamber to said suction chamber, the recess being disposed between the connection and suction chambers.

2. The piston air compressor according to claim 1, further comprising a cylinder head, and wherein at least one of said suction chamber and said connection chamber is disposed in said cylinder head.

3. The piston air compressor according to claim 1, wherein said air duct has a cross-sectional area smaller than about 5 $mm^2$.

4. The piston air compressor according to claim 1, wherein said air duct has an adjustable cross-sectional area.

5. The piston air compressor according to claim 1, wherein said compressor is a single-cylinder piston air compressor.

6. The piston air compressor according to claim 1, wherein said compressor is a two-cylinder piston air compressor.

7. The piston air compressor according to claim 1, wherein said air duct includes a check valve.

8. The piston air compressor according to claim 7, wherein said check valve includes a closing diaphragm, at least a portion of said closing diaphragm defining a contour corresponding to at least a portion of an internal contour of said suction chamber.

9. A commercial motor truck having a pneumatic system comprising a piston air compressor according to claim 1.

10. The piston air compressor according to claim 1, wherein said air duct is a bore in said partition.

11. The piston air compressor according to claim 1, wherein said air duct includes a ball valve.

12. The piston air compressor according to claim 8, wherein said closing diaphragm is formed from sheet metal.

13. The piston air compressor according to claim 1, wherein the compressor is configured to effect an idling mode in which at least a portion of said compressed air passed via said air duct is received by said cylinder from said pressure chamber when said compressor is in an idling mode.

14. The piston air compressor according to claim 1, wherein said recess is located proximate an upper portion of said partition.

15. The piston air compressor according to claim 1, further comprising a bore formed in said partition proximate said air duct.

16. The piston air compressor according to claim 8, wherein said closing diaphragm is configured to allow said compressed air to pass from said connection chamber into said suction chamber depending on the pressure of said compressed air.

17. The piston air compressor according to claim 8, wherein said closing diaphragm is disposed within the suction chamber.

18. The piston air compressor according to claim 1, further comprising a closing diaphragm disposed in said suction chamber such that a suction-chamber side of said air duct is closed off

19. The piston air compressor according to claim 1, wherein said upper surface of said partition faces away from said cylinder.

* * * * *